US007958881B2

(12) United States Patent
Silverson

(10) Patent No.: US 7,958,881 B2
(45) Date of Patent: Jun. 14, 2011

(54) APPARATUS FOR COUPLING A COMPONENT TO AN ARCHERY BOW

(76) Inventor: Tim Douglas Silverson, Whitmore Lake, MI (US)

( * ) Notice: Subject to any disclaimer, the term of this patent is extended or adjusted under 35 U.S.C. 154(b) by 524 days.

(21) Appl. No.: 11/583,227

(22) Filed: Oct. 19, 2006

(65) Prior Publication Data

US 2008/0092868 A1 Apr. 24, 2008

(51) Int. Cl.
*F41B 5/00* (2006.01)
*F41B 5/20* (2006.01)

(52) U.S. Cl. ..... 124/86; 124/88; 124/89

(58) Field of Classification Search ..... 124/23.1, 124/25.6, 86, 87, 88, 89
See application file for complete search history.

(56) References Cited

U.S. PATENT DOCUMENTS 3,412,725 A 11/1968 Hoyt, Jr.
3,491,739 A 1/1970 Scrobell
3,538,902 A * 11/1970 Fowkes ..... 124/88
3,670,712 A 6/1972 Izuta
4,169,454 A 10/1979 Jones
4,245,612 A 1/1981 Finlay
4,252,100 A * 2/1981 Rickard ..... 124/23.1
4,324,222 A 4/1982 Gasser
4,457,287 A * 7/1984 Babington ..... 124/23.1
4,491,123 A 1/1985 Wirtz
4,556,042 A 12/1985 Izuta
4,570,608 A 2/1986 Masterfield
4,584,983 A 4/1986 Ament
4,615,327 A 10/1986 Saunders
4,660,538 A 4/1987 Burgard
4,748,965 A 6/1988 Ament
4,893,606 A 1/1990 Sisko
4,907,567 A 3/1990 Henrich
4,936,283 A 6/1990 Izuta
4,955,356 A 9/1990 Pike et al.
4,957,095 A 9/1990 Cameron
5,016,602 A 5/1991 Mizek
5,090,396 A 2/1992 Bickel et al.
5,253,633 A 10/1993 Sisko
5,339,793 A 8/1994 Findley
5,370,104 A 12/1994 Neie
5,385,136 A 1/1995 Thomas
5,390,656 A 2/1995 Villa et al.
5,433,792 A 7/1995 Darlington
5,471,969 A 12/1995 McDonald, Jr.
5,487,375 A 1/1996 McDonald, Jr.
5,511,533 A 4/1996 Waller
5,524,602 A 6/1996 Papandrea et al.
5,535,731 A 7/1996 Webster
5,558,078 A 9/1996 Dunlap
(Continued)

OTHER PUBLICATIONS

Office Action, dated Jun. 23, 2010, from U.S. Patent and Trademark Office for co-pending U.S. Appl. No. 11/982,091, filed Oct. 31, 2007 (15 pages).

*Primary Examiner* — John Ricci
(74) *Attorney, Agent, or Firm* — Armstrong Teasdale LLP

(57) ABSTRACT

An apparatus is configured to couple a component to an archery bow. The archery bow defines a longitudinal axis and a lateral axis coplanar with and perpendicular to the longitudinal axis, and an opening extending at least partially through the archery bow. The apparatus includes a base positioned within the opening and pivotally movable about the lateral axis. The base defines at least one first passage configured to receive the component.

35 Claims, 15 Drawing Sheets

U.S. PATENT DOCUMENTS 5,584,282 A 12/1996 McDonald, Jr.
5,595,169 A 1/1997 Brown, Jr.
5,611,325 A 3/1997 Kudlacek
5,613,484 A 3/1997 Troncoso
5,615,664 A 4/1997 McDonald, Jr.
5,619,981 A 4/1997 Breedlove
5,649,527 A 7/1997 Olsen et al.
5,657,741 A 8/1997 Todd
5,669,370 A 9/1997 Breedlove
5,735,257 A 4/1998 Walk
5,803,070 A 9/1998 Martin et al.
5,904,134 A 5/1999 Denbow
5,911,215 A * 6/1999 Fisher, Jr. ..... 124/86
5,934,266 A 8/1999 Martin et al.
5,937,843 A 8/1999 Troncoso
5,944,004 A 8/1999 Goff et al.
5,975,070 A 11/1999 Sands
5,992,403 A 11/1999 Slates
5,996,570 A 12/1999 Legate
6,021,770 A 2/2000 Sodaro
6,076,514 A 6/2000 Adams, Jr.
6,085,736 A 7/2000 Osterhues
6,092,516 A 7/2000 Martin et al.
6,176,231 B1 1/2001 Smith
6,186,135 B1 2/2001 Harwath et al.
6,283,109 B1 9/2001 Wiseby et al.
6,298,842 B1 10/2001 Sims
6,431,163 B1 8/2002 Chipman
6,494,196 B2 12/2002 Harwath et al.
6,568,382 B2 * 5/2003 Martin et al. ..... 124/86
6,612,299 B2 * 9/2003 Martin et al. ..... 124/86
6,681,755 B2 1/2004 Pujos
6,718,964 B1 4/2004 Graf
6,802,307 B2 10/2004 Leven
6,817,352 B1 11/2004 Saunders
6,997,174 B2 2/2006 Sandberg
7,066,165 B2 * 6/2006 Perry ..... 124/23.1
7,381,138 B2 6/2008 Dillner et al.
2003/0226556 A1 12/2003 Leven
2005/0011509 A1 1/2005 Sandberg

* cited by examiner

APPARATUS FOR COUPLING A COMPONENT TO AN ARCHERY BOW

BACKGROUND OF THE INVENTION

This invention relates generally to archery bows and, more particularly, to an apparatus for coupling a component, such as a stabilizer or a vibration dampener, to an archery bow.

Conventional bow stabilizers and vibration dampeners have been developed to absorb, dampen and/or reduce recoil, vibration, shock and/or noise resulting from a release of an archery arrow supported on an archery bow. These conventional devices are typically fixedly coupled to the archery bow to limit or reduce such recoil, vibration, shock and/or noise to improve the stability of the archery bow during and/or after the archery arrow is released from the archery bow, thus, improving the shooting accuracy.

BRIEF DESCRIPTION OF THE INVENTION

In one aspect, an apparatus configured to couple a component to an archery bow is provided. The archery bow defines a longitudinal axis and a lateral axis coplanar with and perpendicular to the longitudinal axis, and an opening extending at least partially through the archery bow. The apparatus includes a base positioned within the opening and pivotally movable about the lateral axis. The base defines at least one first passage configured to receive the component.

In another aspect, an apparatus configured to couple a component to an archery bow is provided. The archery bow defines a longitudinal axis and a lateral axis coplanar with and perpendicular to the longitudinal axis, and a z-axis intersecting the longitudinal axis and the lateral axis and perpendicular thereto. The archery bow defines a bore extending along the lateral axis and at least one slot formed along a slot centerline coplanar with the longitudinal axis. The at least one slot interferes with the bore. The apparatus includes a base positioned within the bore and pivotally movable about the lateral axis. The base defines at least one passage aligned with the at least one slot and configured to receive the component.

In another aspect, an apparatus configured to couple a component to an archery bow is provided. The archery bow defines a longitudinal axis and a lateral axis coplanar with and perpendicular to the longitudinal axis. The archery bow further defines a slot along a slot centerline coplanar with the longitudinal axis. The apparatus includes a base positioned within the slot and pivotally movable about the lateral axis. The base defines at least one first passage configured to receive the component.

In another aspect, an apparatus configured to couple a component to an archery bow is provided. The archery bow defines a longitudinal axis and a lateral axis coplanar with and perpendicular to the longitudinal axis, and an opening extending at least partially through the archery bow along the lateral axis. The apparatus includes a base positioned within the opening and pivotally movable about the lateral axis. The base defines at least one first passage configured to receive the component. A locking mechanism is operatively coupled to the base and configured to selectively retain the base stationary within the opening.

In another aspect, an apparatus for coupling a component to an archery bow is provided. The archery bow defines a longitudinal axis and a lateral axis coplanar with and perpendicular to the longitudinal axis, and a z-axis intersecting the longitudinal axis and the lateral axis and perpendicular thereto. The archery bow further defines an opening extending at least partially through the archery bow. The apparatus includes a base positioned within the opening. The base is pivotally movable to position the component with respect to at least one of the longitudinal axis, the lateral axis and the z-axis.

In another aspect, a method is provided for coupling a component to an archery bow. The archery bow defines a longitudinal axis and a lateral axis coplanar with and perpendicular to the longitudinal axis, and a z-axis intersecting the longitudinal axis and the lateral axis and perpendicular thereto. The method includes positioning at least a portion of an apparatus base within the archery bow; coupling the component to the base; and pivotally moving the base with respect to the archery bow to selectively position the component with respect to at least one of the longitudinal axis, the lateral axis and the z-axis.

In another aspect, an archery bow is provided. The archery bow defines a lateral axis and an opening extending at least partially through the archery bow. The archery bow includes an apparatus having a base positioned within the opening and pivotally movable about the lateral axis. The base defines at least one first passage. A component is mounted within the at least one first passage. The archery bow is configured to enable a user to select an orientation of the component with respect to an axis of the archery bow.

In another aspect, a stabilizer for an archery bow is provided. The archery bow defines a longitudinal axis and a lateral axis coplanar with and perpendicular to the longitudinal axis, and a z-axis intersecting the longitudinal axis and the lateral axis and perpendicular thereto. The archery bow further defines an opening extending at least partially through the archery bow. The stabilizer includes a base pivotally positioned within the opening. The base is movable within the opening to position a shaft removably coupled to the base with respect to the z-axis.

DETAILED DESCRIPTION OF THE INVENTION

The present invention provides a method and apparatus for coupling a component, such as a bow stabilizer or vibration dampener, to an archery bow. As described below, the apparatus includes a base that is removably positioned within an opening, such as a bore and/or a slot, defined within a riser section of the archery bow. The base is movable, such as pivotally, rotatably and/or translationally movable, within the opening to position a component, such as a stabilizer or a vibration dampener, at an angular position with respect to at least one of a longitudinal axis, a lateral axis and a z-axis of the archery bow, which is perpendicular to a plane defining the longitudinal axis and the lateral axis of the archery bow. The apparatus as described herein is configured to couple any suitable archery component or element to the archery bow. Further, the archery bow may be retrofitted to accommodate the apparatus.

Figure 1:
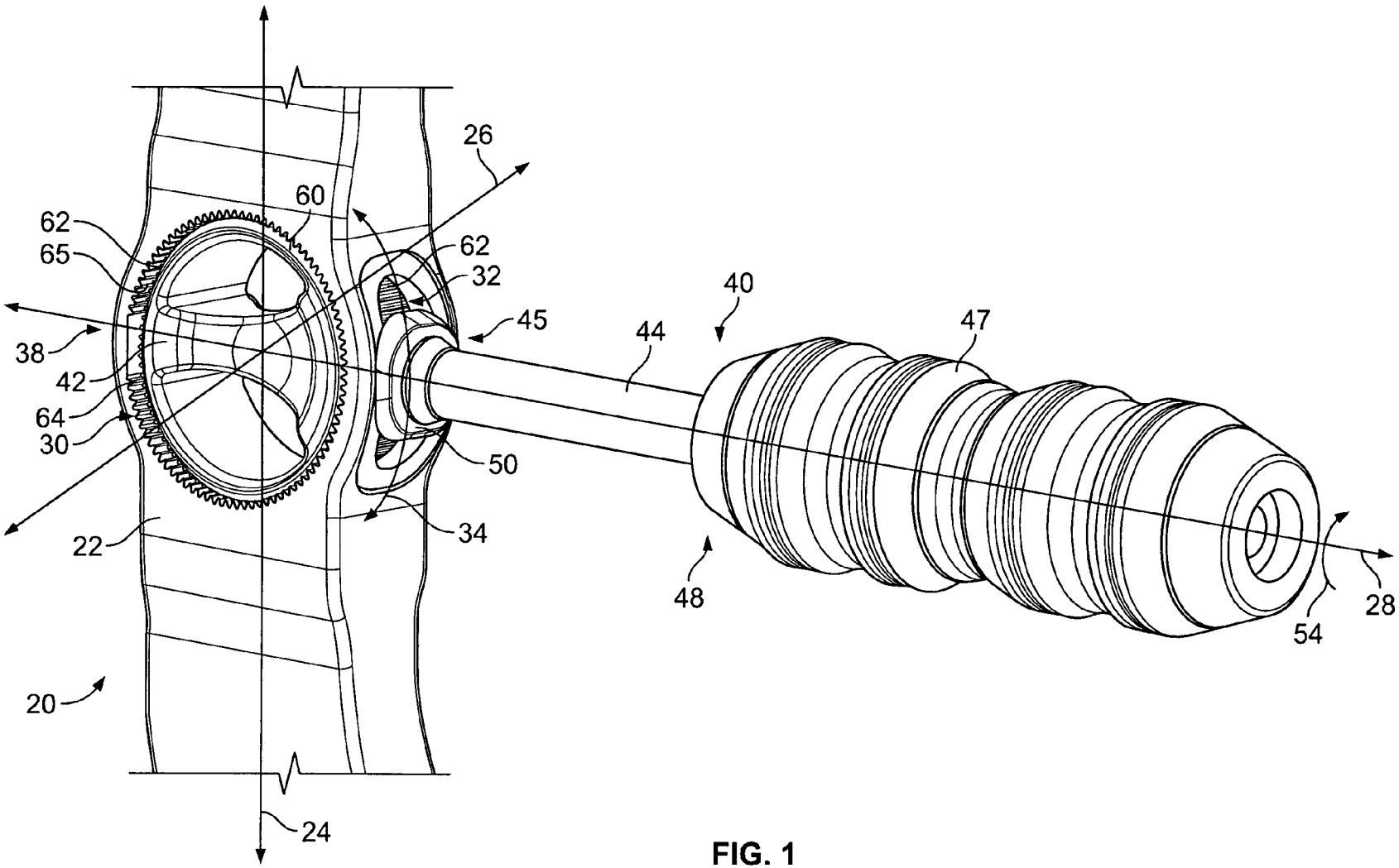
FIG. 1 is a perspective view of an exemplary bow stabilizer coupled to an archery bow and positioned at a first position coaxial with a z-axis of the archery bow.

Referring to FIG. 1, an archery bow 20 includes a riser section 22. Archery bow 20 defines orthogonal axial components including a longitudinal axis 24 and a lateral axis 26 coplanar with and perpendicular to longitudinal axis 24. Further, a z-axis 28 of archery bow 20 intersects and is perpendicular to a plane in which longitudinal axis 24 and lateral axis 26 are defined. Z-axis 28 is generally parallel to a draw axis of archery bow 20 that defines a direction in which an archer draws an archery arrow prior to releasing the archery arrow from archery bow 22.

Figure 10:
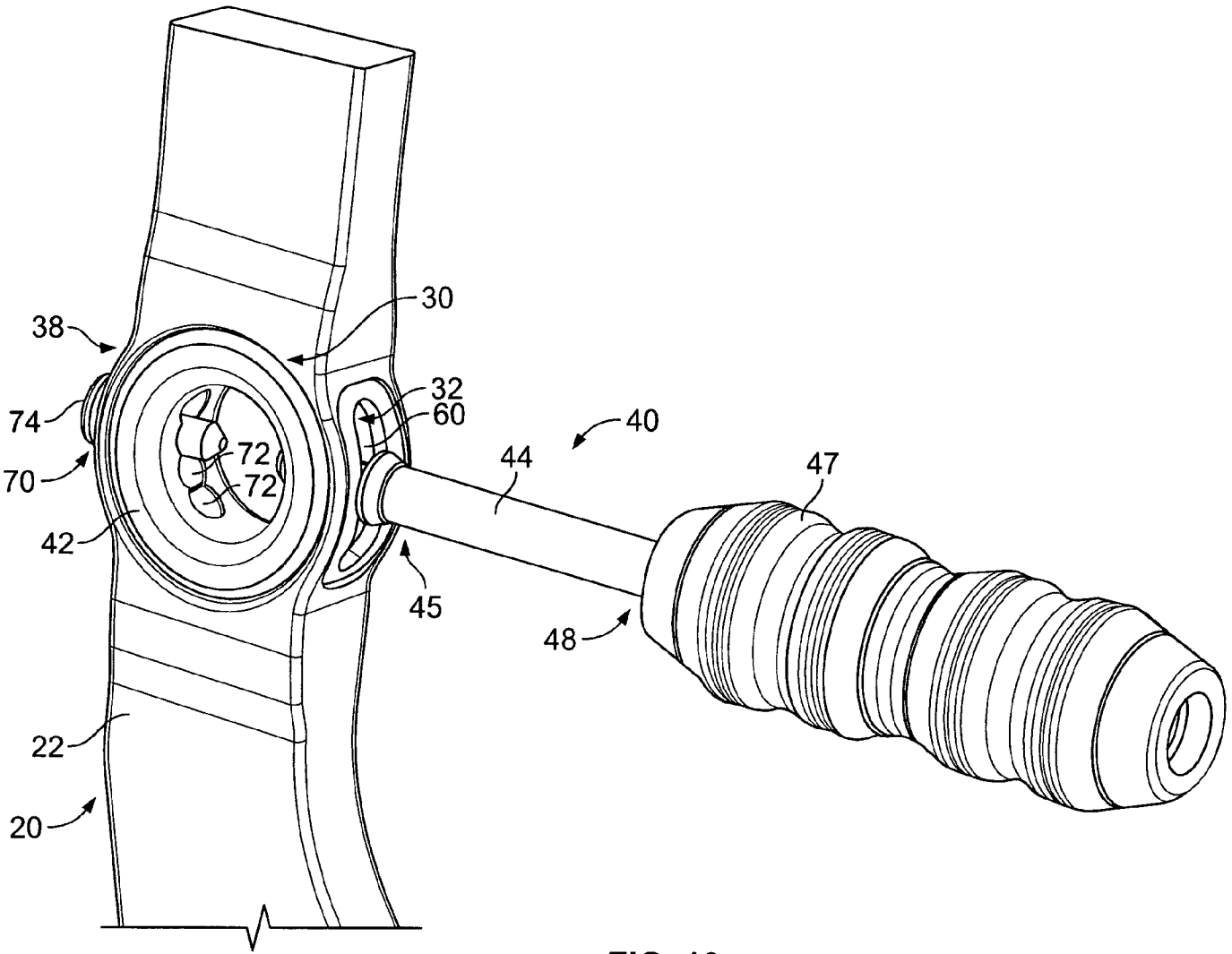
FIG. 10 is a perspective view of an alternative bow stabilizer coupled to an archery bow.

Archery bow 20 defines an opening or void extending at least partially through archery bow 20. As shown in FIG. 1, in one embodiment, archery bow 20 defines a bore 30 that extends along lateral axis 26 and at least partially through archery bow 20. In an alternative embodiment, archery bow 20 defines a plurality of bores 30, as shown in FIG. 10. In this embodiment, archery bow 20 further defines at least one slot 32 formed along a centerline 34 coplanar with longitudinal axis 24. Slot 32 interferes or intersects with bore 30 to provide communication between bore 30 and slot 32. In one embodiment, slot 32 extends along at least a portion of an outer surface of archery bow 20 and extends radially inwardly towards lateral axis 26 to intersect bore 30, as shown in FIG. 1. It is apparent to those skilled in the art and guided by the teachings herein provided that any suitable number of slots 32 may be defined within archery bow 20. Further, slot(s) 32 may have any suitable shape and/or size.

Referring now to FIGS. 1-12, in one embodiment, an apparatus 38 couples an archery component or element, such as a bow stabilizer 40 or any other suitable archery component or element, to archery bow 20. In a particular embodiment, the component is removably coupled to archery bow 20 for facilitating absorbing and/or reducing recoil, vibration, shock and/or noise resulting from a release of an archery arrow supported on archery bow 20. It is apparent to those skilled in the art and guided by the teachings herein provided that apparatus 38 may be utilized to couple any suitable bow stabilizer, as well as any other suitable archery component and/or element, to archery bow 20 at riser section 22 and/or at any suitable area or region of archery bow 20.

Apparatus 38 includes a base 42 that is removably positioned within at least one opening defined by archery bow 20, such as bore 30, as shown in FIGS. 1-12. Referring further to FIG. 10, in a particular embodiment, base 42 is removably positionable within any bore 30 of a plurality of bores 30 defined within bow riser portion 22. As described in greater detail below, in one embodiment, base 42 is movable within bore 30, such as rotationally, pivotally and/or translationally movable within bore 30. In a particular embodiment, base 42 is rotatably or pivotally movable within bore 30 with respect to or about longitudinal axis 24, lateral axis 26 and/or z-axis 28.

In one embodiment, archery bow 20 defines lateral axis 26 and an opening extending at least partially through archery bow 20. Archery bow 20 includes apparatus 38 having base 42 positioned within the opening and pivotally movable about lateral axis 26. Base 42 defines at least one passage 51, as described in greater detail below, and a component mounted within passage 51. Archery bow 20 is configured to enable a user to select an orientation of the component with respect to longitudinal axis 24, lateral axis 26 coplanar and/or z-axis 28 of archery bow 20. In one embodiment, the component includes a sight, a vibration dampener and/or a stabilizer, for example. In alternative embodiments, any suitable component may be coupled to archery bow 20. In a further embodiment, base 42 and the component are collinear.

Figure 2:
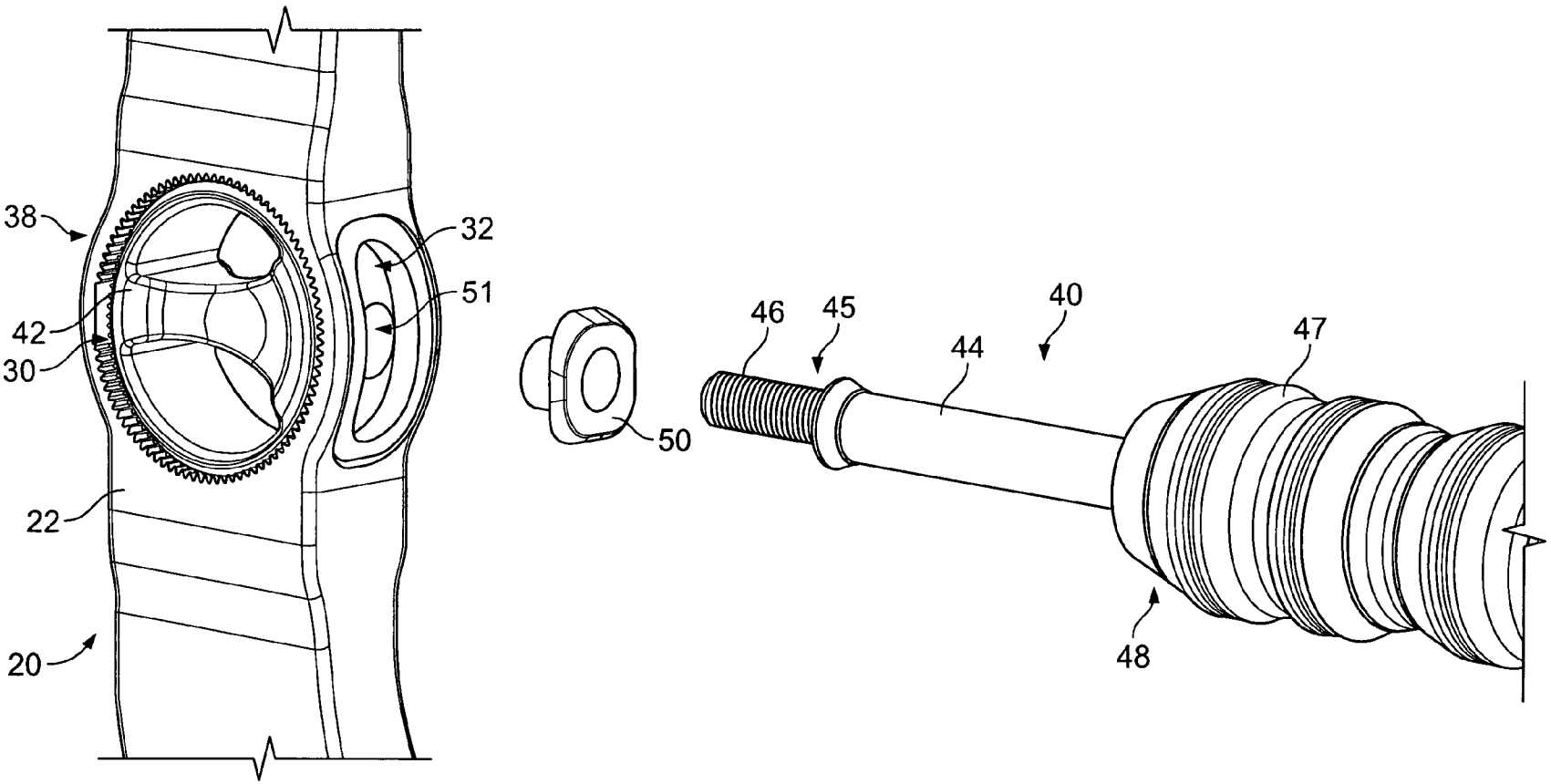
FIG. 2 is an exploded perspective view of the bow stabilizer shown in FIG. 1.
Figure 3:
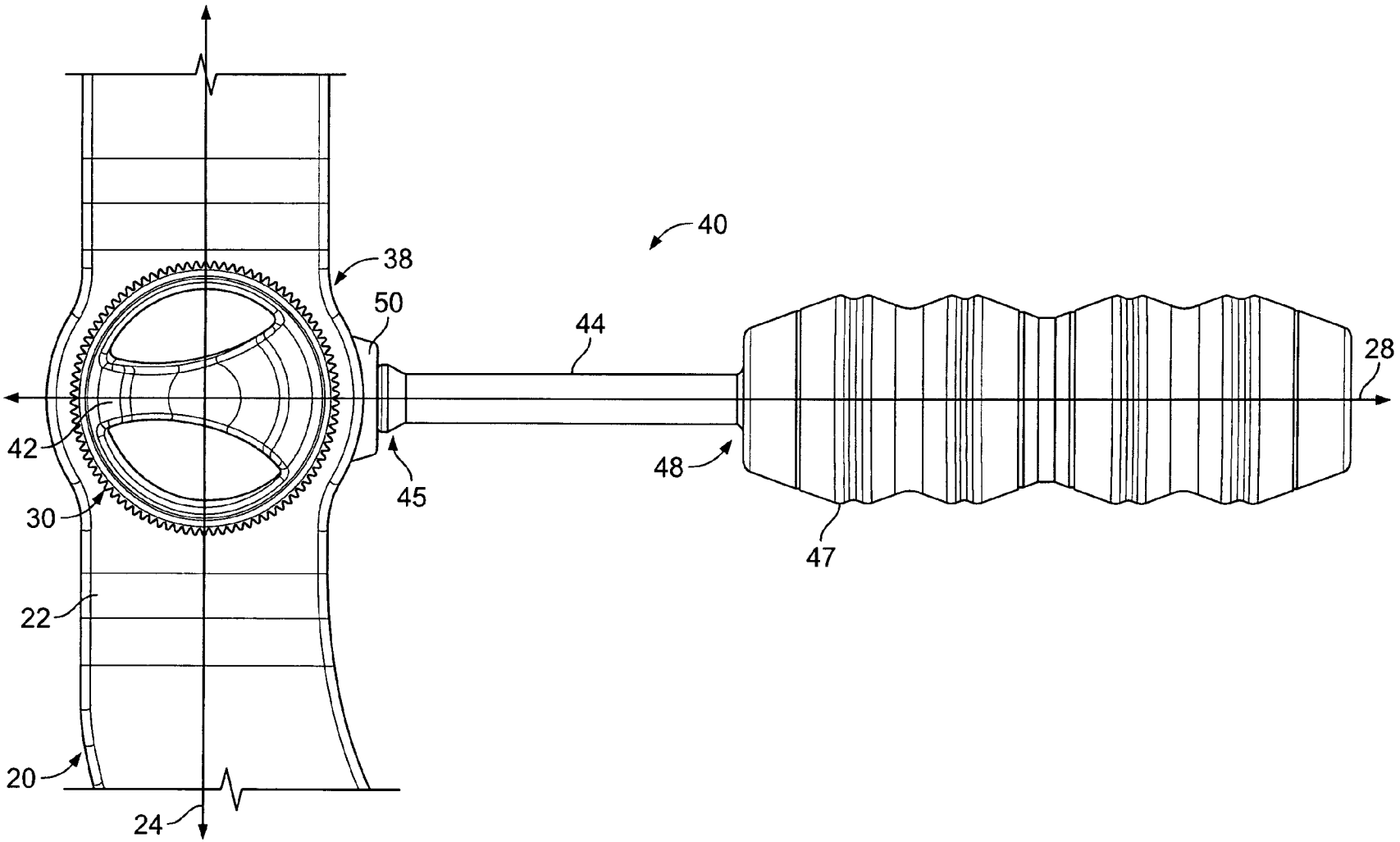
FIG. 3 is a side view of the bow stabilizer shown in FIG. 1.

Bow stabilizer 40 includes a shaft 44 that is removably coupled at a first end 45 to base 42. As shown in FIGS. 1-12, first end 45 extends through slot 32 and is coupled to base 42. In one embodiment, shaft 44 is threadedly coupled to base 42. In this embodiment as shown in FIG. 2, first end 45 forms a helical thread 46 that is threadedly received within a complementary passage defined within base 42. In an alternative embodiment, first end 45 is compression fitted or friction fitted within a passage defined within base 42. In a further alternative embodiment, shaft 44 is positioned within a collar and the collar is positioned within the passage defined within base 42.

Figure 9:
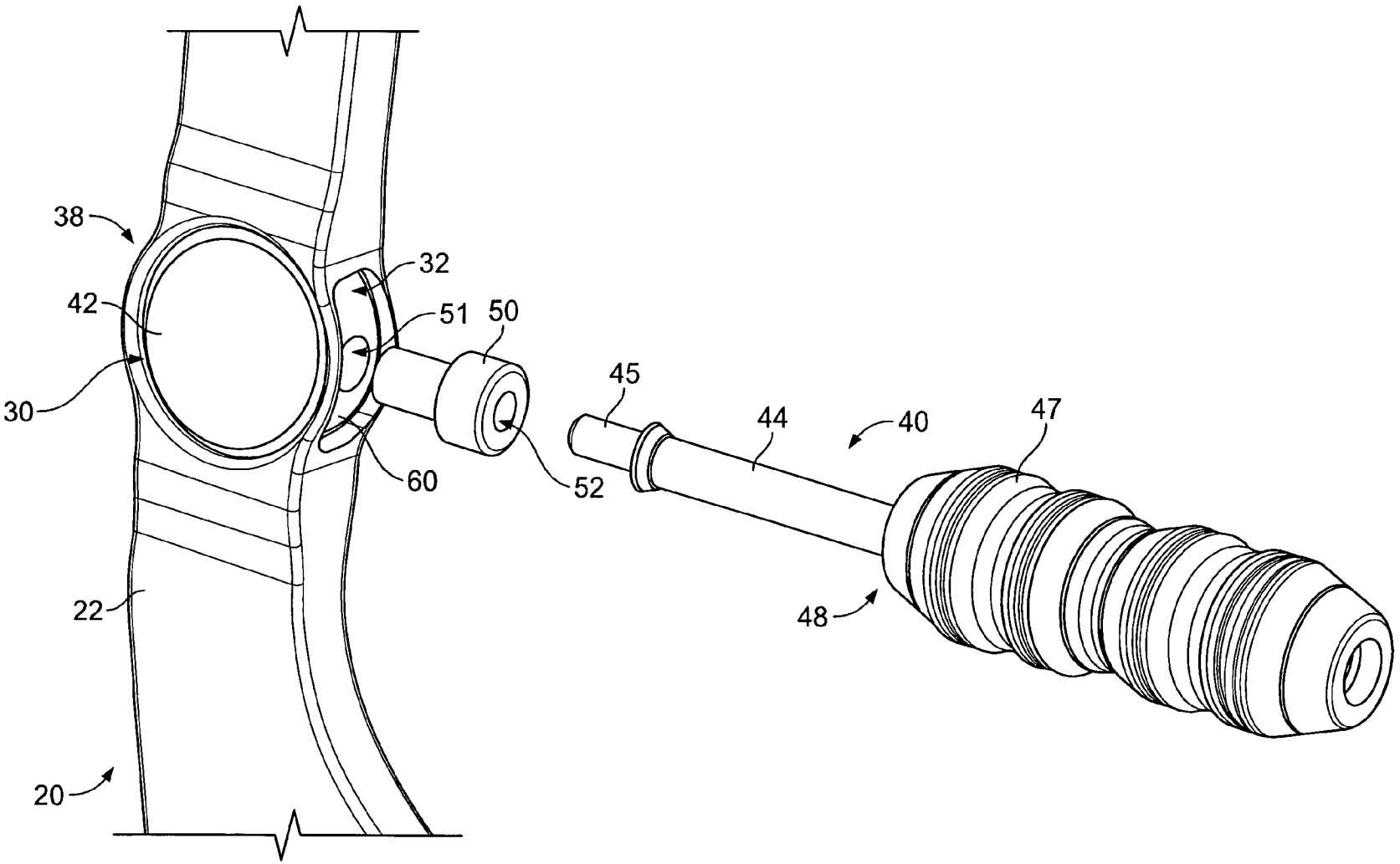
FIG. 9 is an exploded perspective view of the bow stabilizer shown in FIG. 8.

Bow stabilizer 40 also includes a body 47 coupled to shaft 44, such as at a second end 48 of shaft 44 opposing first end 45. In one embodiment, apparatus 38 includes a collar 50 that is coupled to base 42. Collar 50 is positioned about at least a portion of shaft 44 and within slot 32 for facilitating moving shaft 44 with respect to z-axis 28, as described in greater detail below. In a particular embodiment, a portion of collar 50 is positionable within passage 51 defined within base 42, as shown in FIG. 9. Collar 50 defines a passage 52 within which first end 45 of shaft 44 is removably positioned. With passage 51 aligned with or in communication with slot 32, passage 51 is configured to receive collar 50, as shown in FIG. 9, or configured to receive the component. Passage 51 defines an axis that is coplanar with longitudinal axis 24. In an alternative embodiment, collar 50 is integrally formed with base 42 or shaft 44 as shown in FIGS. 11-15.

Figure 4:
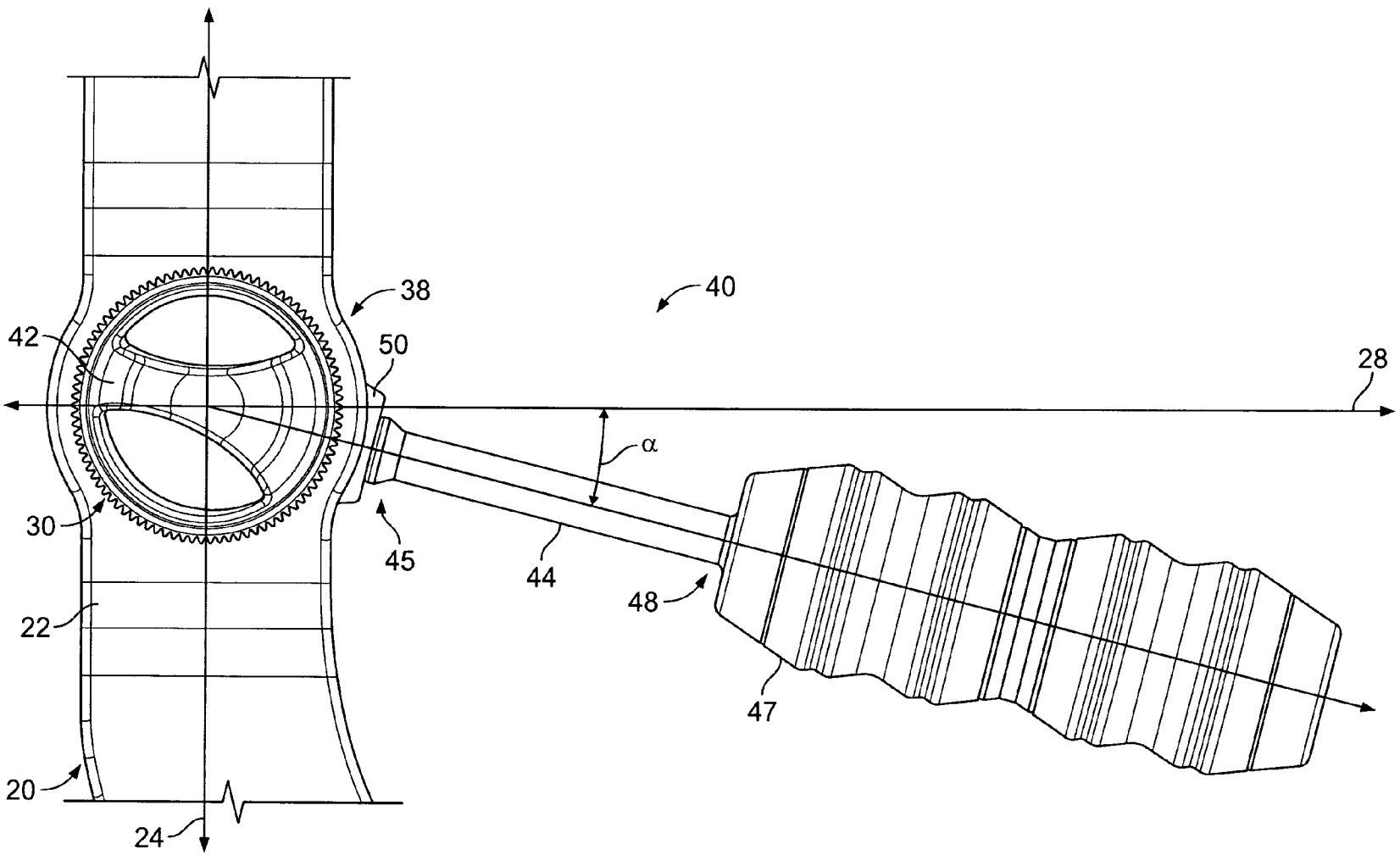
FIG. 4 is a side view of the bow stabilizer shown in FIG. 1 positioned at a selected angular position with respect to the first position.

In one embodiment, base 42 is pivotally mounted or positioned within archery bow 20 to position shaft 44 at a selected angular position with respect to z-axis 28. Base 42 is pivotally movable about lateral axis 26 to position the component at a selected angular position with respect to archery bow 20. Referring further to FIG. 4, shaft 44 is movable to an angular position $\alpha$ Angular position $\alpha$ may be any suitable angular position, such as between about 0° and about +/−75° with respect to z-axis 28. It is apparent to those skilled in the art and guided by the teachings herein provided that the angular position of shaft 44 with respect to z-axis 28 can be limited to any suitable angle range. In a particular embodiment, with shaft 44 at the selected angular position, shaft 44 is rotated in a clockwise direction shown by directional arrow 54 in FIG. 1 about an axis of shaft 44 to selectively lock or retain base 42 stationary within bore 30 such that shaft 44 is retained at the selected angular position with respect to z-axis 28. Shaft 44 is rotated in an opposite counter-clockwise direction to allow the angular position of shaft 44 to be adjusted, as desired.

Figure 5:
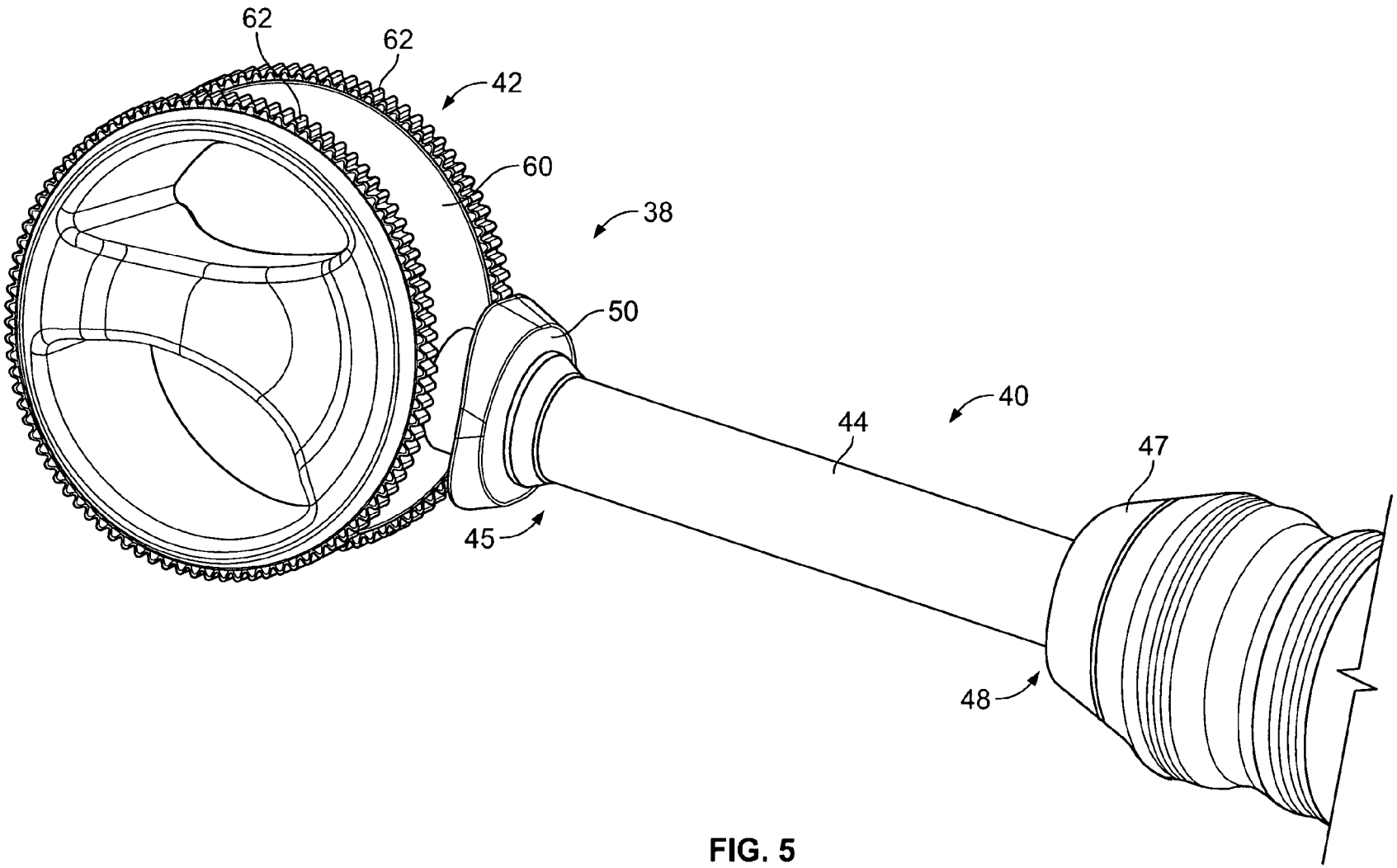
FIG. 5 is a perspective view of an exemplary bow stabilizer.
Figure 6:
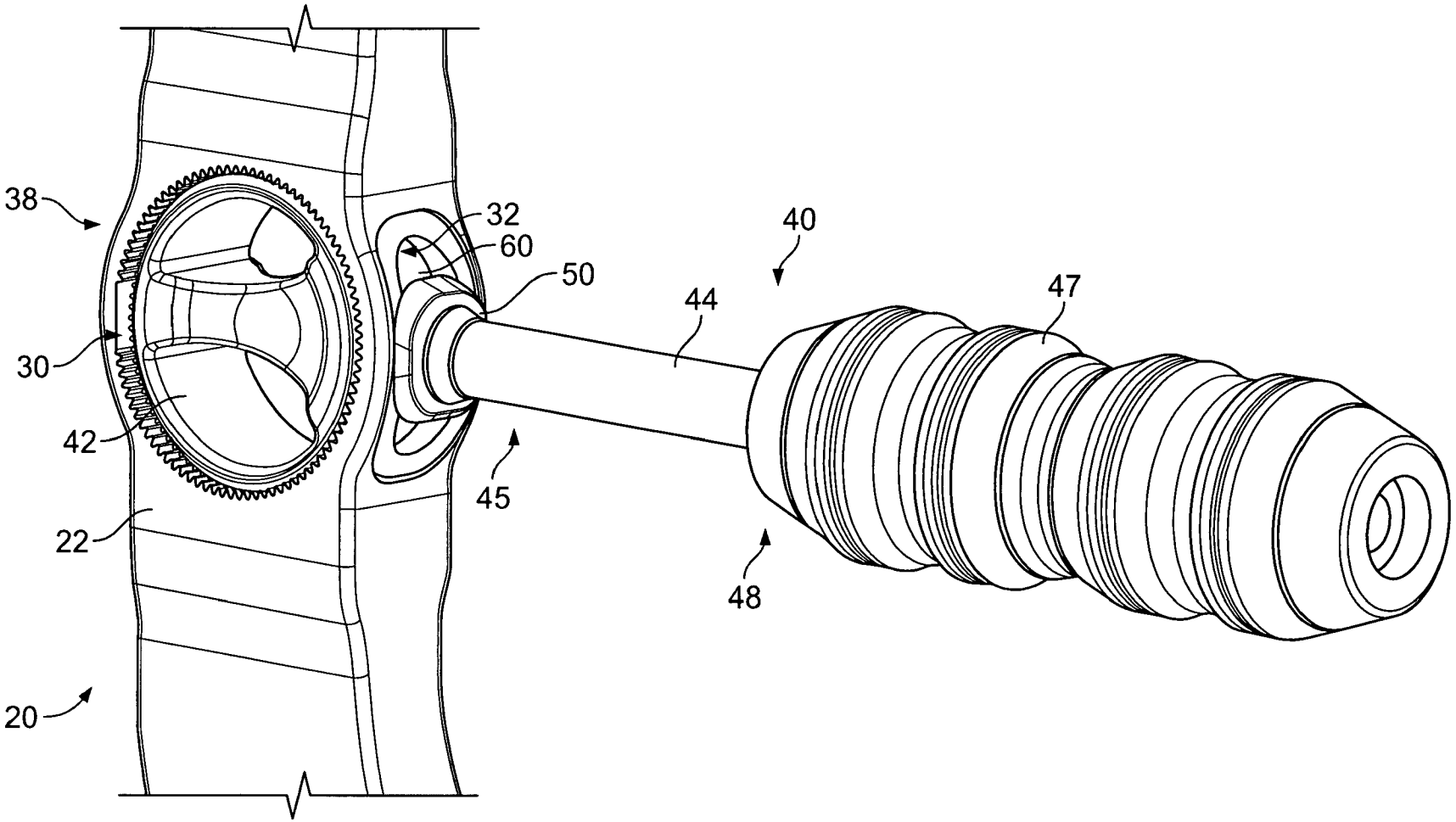
FIG. 6 is a perspective view of the bow stabilizer shown in FIG. 5 coupled to an archery bow and positioned at a first position coaxial with a z-axis of the archery bow.
Figure 7:
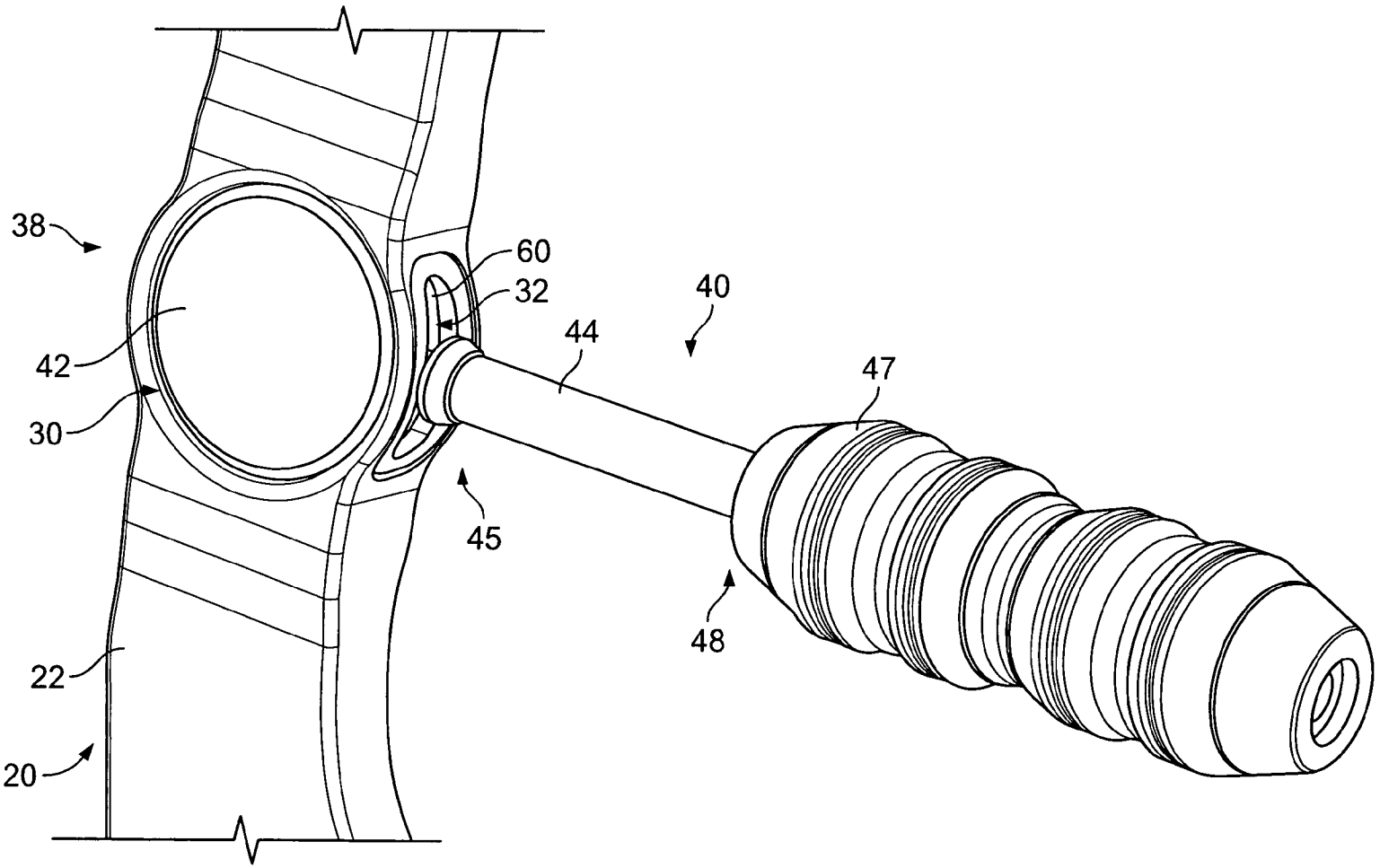
FIG. 7 is a perspective view of an alternative bow stabilizer coupled to an archery bow.
Figure 8:
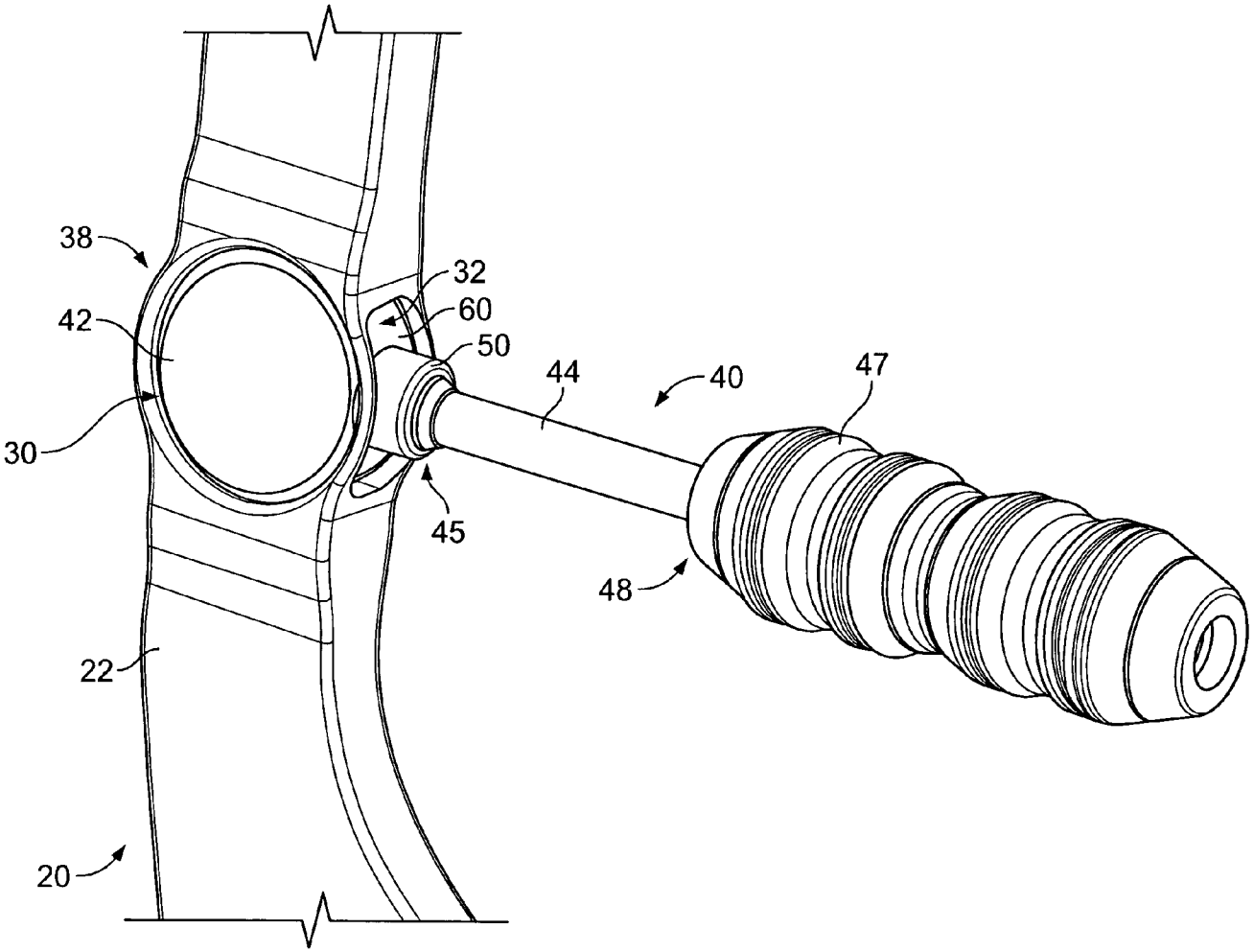
FIG. 8 is a perspective view of an alternative bow stabilizer coupled to an archery bow.

Referring further to FIGS. 1-6, at least a portion of a contact surface 60 of base 42 includes a knurled surface or a plurality of projections, such as threads 62, that interfere with or provide frictional contact between base 42 and an inner surface of archery bow 20 forming bore 30 for facilitating positioning shaft 44 at a desired angular position with respect to z-axis 28. In one embodiment, as shown in FIG. 1, contact surface 60 defines a plurality of threads 62 that extend along a width of base 42 in a direction generally parallel to lateral axis 26. A plurality of cooperating threads 64, as shown in FIG. 1, are formed in a cooperating inner surface 65 of archery bow 20 defining bore 30. In an alternative embodiment, threads 62 and/or cooperating threads 64 are discontinuous and extend along a portion of the base width, as shown in FIG. 5.

Figure 11:
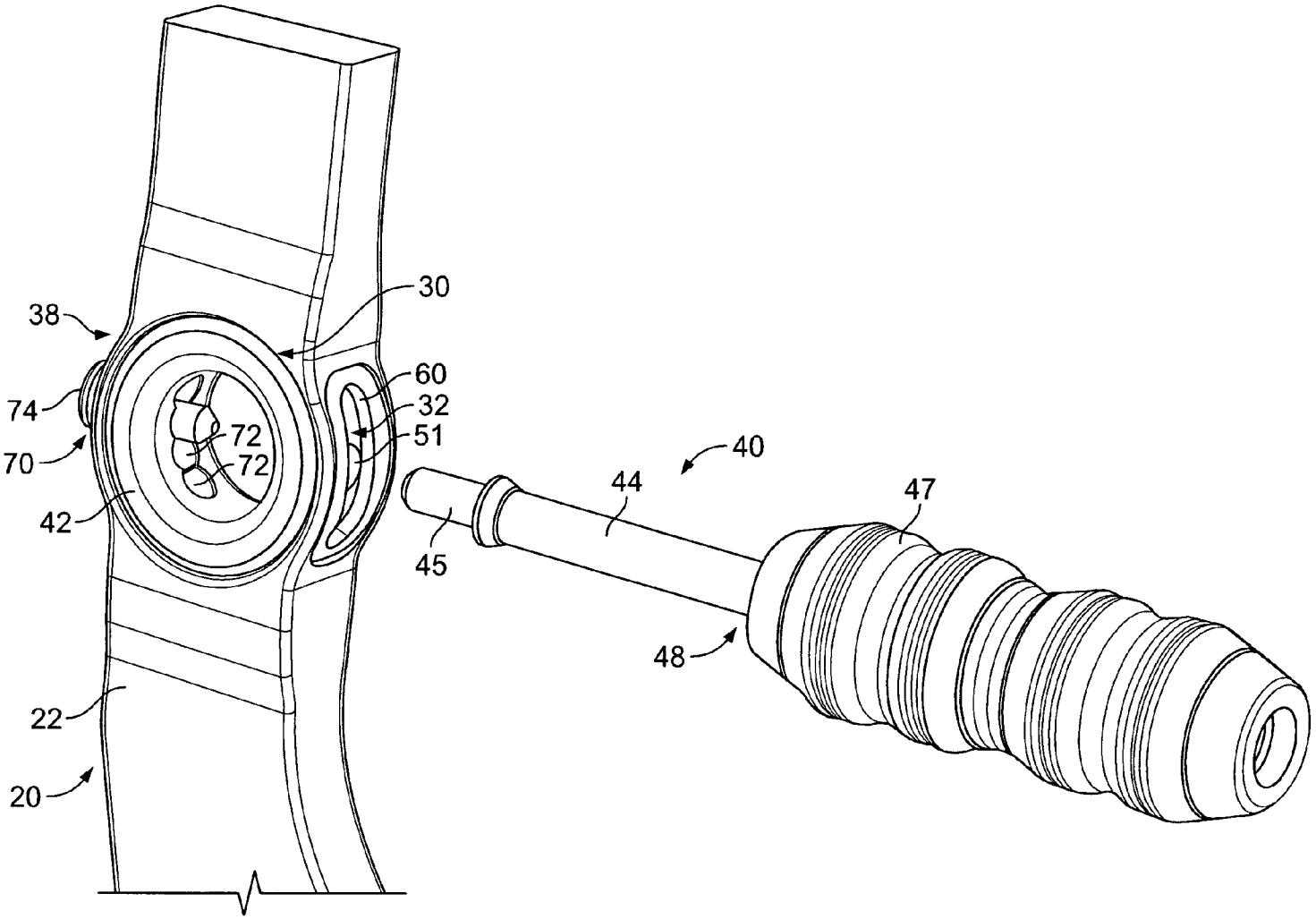
FIG. 11 is an exploded perspective view of the bow stabilizer shown in FIG. 10.

As shown in FIGS. 10 and 11, in an alternative embodiment, a locking mechanism 70 is operatively coupled to base 42 and configured to fixedly position base 42 within bore 30 to selectively retain shaft 44 at an angular position with respect to z-axis 28. As shown in FIG. 10, in this alternative embodiment a plurality of apertures 72 are defined within base 42. With the angular position of shaft 44 selected and one aperture 72 aligned with a cooperating aperture defined within archery bow 20 (not shown), locking mechanism 70 includes a pin 74 that is positioned within the archery bow aperture and aligned base aperture 72. In a particular embodiment, pin 74 is threadedly engaged within the archery bore aperture and/or aligned base aperture 72. It is apparent to those skilled in the art and guided by the teachings herein provided that locking mechanism 70 may include any suitable component or mechanism that is configured to secure base 42 within bore 30 and retain shaft 44 in a desired angular position with respect to z-axis 28.

Figure 12:
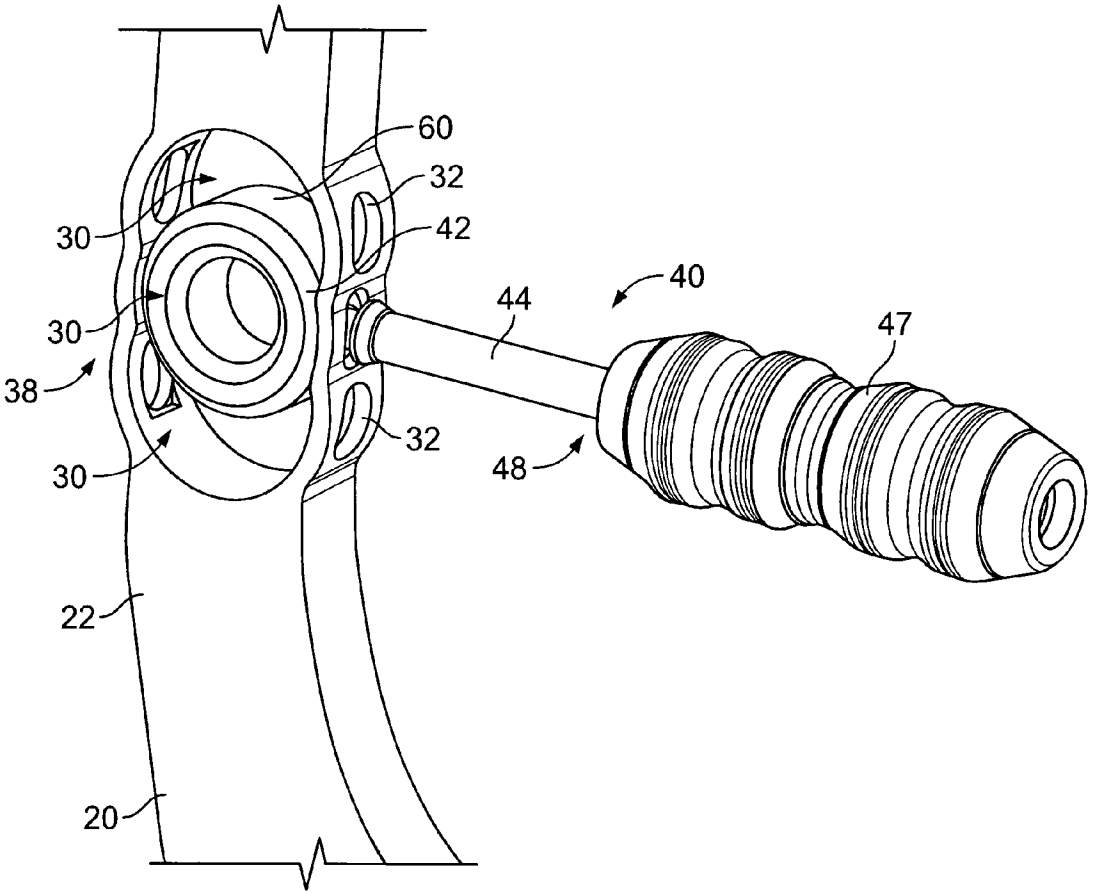
FIG. 12 is a perspective view of an alternative bow stabilizer coupled to an archery bow.

As shown in FIG. 12, base 42 is selectively positioned within one bore 30 of a plurality of bores 30 defined within archery bow 20. Bores 30 may intersect with adjacent bores 30, as shown in FIG. 12, or, alternatively, bores 30 may be defined without intersecting adjacent bores 30. Such configurations allow the archer to position base 42 within a desired bore 30. Further, archery bow 20 defines a plurality of slots 32. Slots 32 may intersect with adjacent slots 32, as shown in FIG. 12, or, alternatively, slots 32 may be defined without intersecting adjacent slots 32. Slots 32 may be sized and/or shaped to allow shaft 44 to move within slot 32 parallel to longitudinal axis 24 and/or lateral axis 26 of archery bow 20. Alternatively, slots 32 may be sized and/or shaped to prevent or limit such axial movement. Base 42 is secured within bore 30 to retain shaft 44 at a selected angular position with respect to z-axis 28. In one embodiment, shaft 44 is rotated about a shaft axis to tighten shaft 44 against base 42 and retain shaft 44 at the selected angular position. Alternatively, a suitable locking mechanism 70 (not shown in FIG. 12) retains base 42 stationary within bore 30 or slot 32 such that shaft 44 is retained in the selected angular position.

Figure 13:
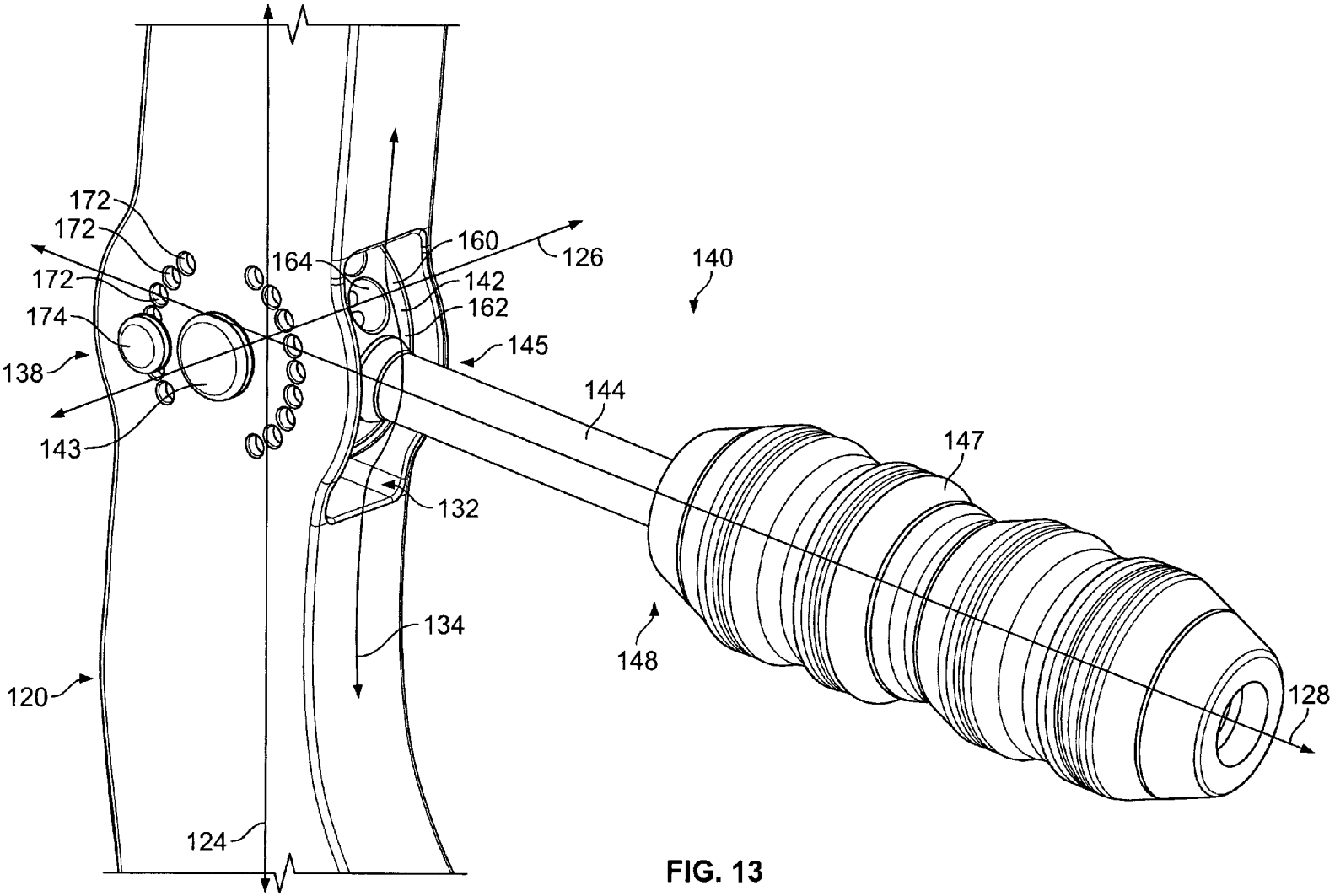
FIG. 13 is a perspective view of an alternative bow stabilizer coupled to an archery bow.
Figure 14:
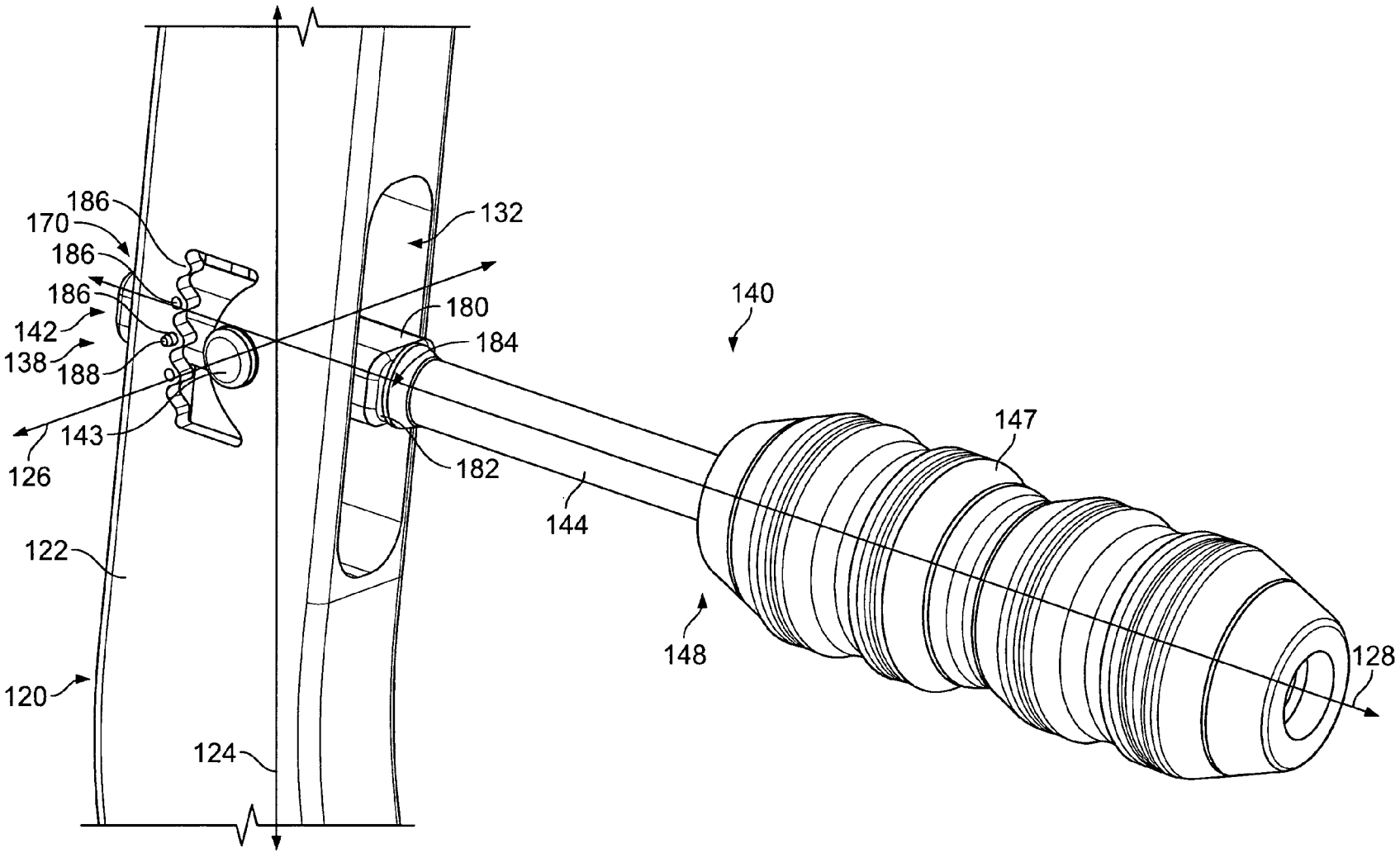
FIG. 14 is a perspective view of an alternative bow stabilizer coupled to an archery bow.
Figure 15:
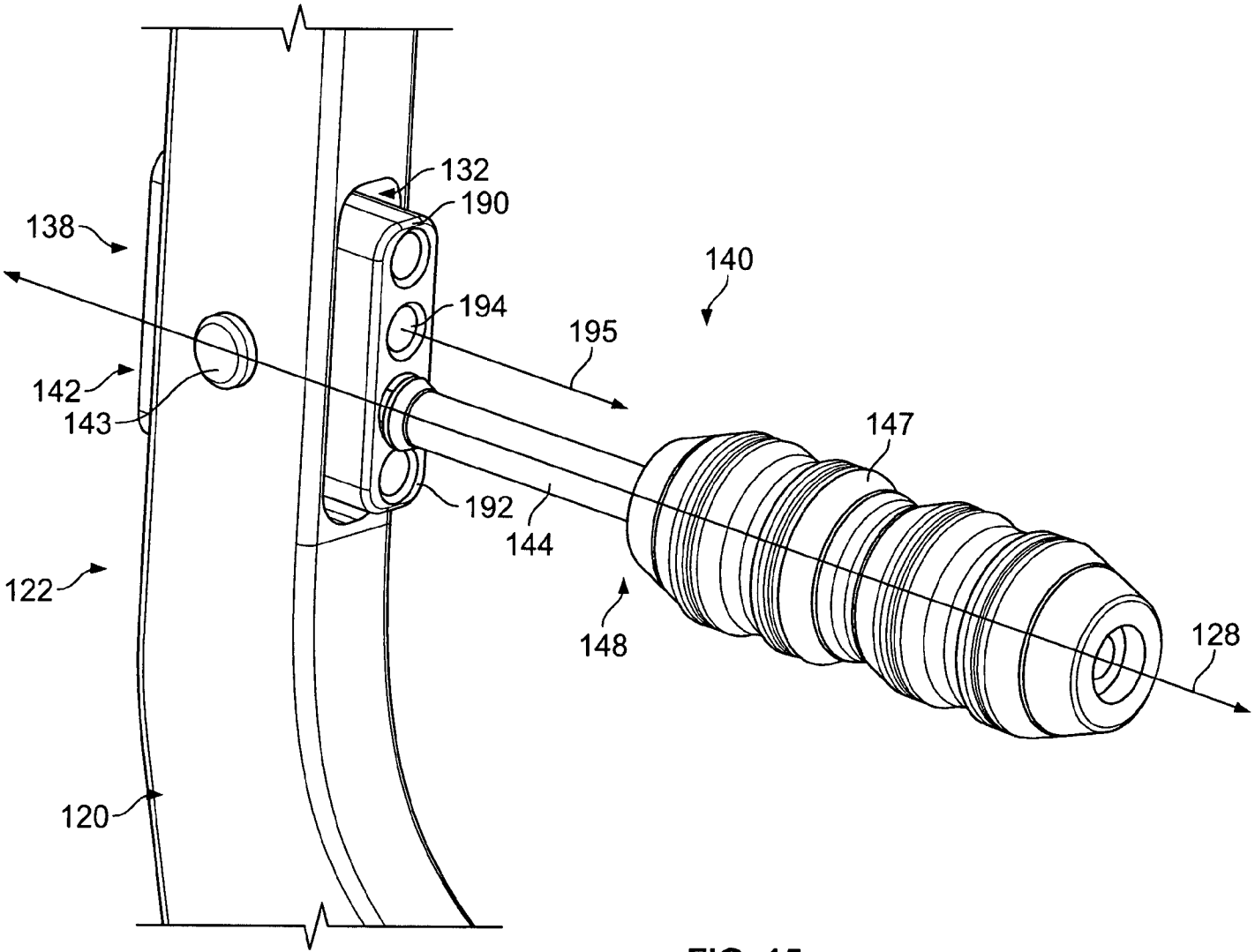
FIG. 15 is a perspective view of an alternative bow stabilizer coupled to an archery bow.

Referring to FIGS. 13-15, in an alternative embodiment, an apparatus 138 couples an archery component or element, such as a bow stabilizer 140 or any other suitable archery component or element, to archery bow 120. In a particular alternative embodiment, the component is removably coupled to archery bow 120 for facilitating absorbing and/or reducing recoil, vibration, shock and/or noise resulting from a release of an archery arrow supported on archery bow 120. Archery bow 120 defines orthogonal axial components including a longitudinal axis 124 and a lateral axis 126 coplanar with and perpendicular to longitudinal axis 124. Further, a z-axis 128 of archery bow 120 intersects and is perpendicular to a plane in which longitudinal axis 124 and lateral axis 126 are defined. Z-axis 128 is generally parallel to a draw axis of archery bow 120 that defines a direction in which an archer draws an archery arrow prior to shooting the archery arrow. Archery bow 20 further defines at least one slot 132 having a centerline 134 coplanar with longitudinal axis 124. Slot 132 extends along at least a portion of an outer surface of archery bow 120. It is apparent to those skilled in the art and guided by the teachings herein provided that any suitable number of slots 132 may be defined within archery bow 120. Further, slot(s) 132 may have any suitable shape and/or size.

Apparatus 138 includes a base 142 that is at least partially positioned within slot 132, as shown in FIGS. 13-15. It is apparent to those skilled in the art and guided by the teachings herein provided that base 142 may include any suitable geometric shape including, without limitation, a disc as shown in FIG. 13 or a block as shown in FIGS. 14 and 15. As described in greater detail below, in one embodiment, base 142 is movable within slot 132, such as rotationally, pivotally and/or translationally movable within slot 132. Bow stabilizer 140 is coupled to archery bow 120. More specifically, base 142 includes a bore (not shown) through a width of base 142 that extends along lateral axis 126. Further, archery bow 120 includes a corresponding bore (not shown) that extends at least partially through archery bow 120 along lateral axis 126. With base 142 positioned at least partially within slot 132 and the base bore aligned with the archery bow bore along lateral axis 126, a suitable coupling mechanism or component 143, such as a bolt, a screw or a pin, is inserted into the archery bow bore and the aligned base bore to rotatably couple base 142 to archery bore 120. In this embodiment, base 142 is rotatable within slot 132 with respect to archery bow 120.

Bow stabilizer 140 includes a shaft 144 that is removably coupled at a first end 145 to base 142. As shown in FIGS. 13-15, first end 145 extends at least partially into slot 132 and is coupled to base 142. In one embodiment, shaft 144 is threadedly coupled to base 142. In this embodiment, first end 145 forms a helical thread that is threadedly received within a complementary passage defined by base 142. In an alternative embodiment, first end 145 is compression fitted or friction fitted within a passage defined by base 142. Bow stabilizer 140 also includes a body 147 coupled to shaft 144, such as at a second end 148 of shaft 144 opposing first end 145.

In one embodiment, apparatus 138 includes a collar 150 that is coupled to base 142. Collar 150 is positioned about at least a portion of shaft 144 and/or within slot 132 for facilitating angular movement of shaft 144 with respect to z-axis 128, as described in greater detail below.

As shown in FIG. 13, in one embodiment base 142 forms a disc 160 having an outer peripheral surface 162 defining a plurality of passages 164 that extend radially inwardly towards a center axis of disc 160 coaxially positioned with lateral axis 126. Each passage 164 is configured to receive shaft 144 or, in certain embodiments, collar 150. A locking mechanism 170 fixedly secures base 142 in a selected rotational position within slot 132 to retain shaft 144 at an angular position with respect to z-axis 128. As shown in FIG. 13, a plurality of positioning apertures 172 is defined within archery bow 120. Positioning apertures 172 are positioned about coupling mechanism 143 in an arcuate configuration to align with a corresponding aperture (not shown) defined within disc 160. In a particular embodiment, a plurality of corresponding apertures are defined within disc 160 with each aperture alignable with a positioning aperture 172. With the desired disc aperture aligned with the corresponding positioning aperture 172, a pin 174 is positioned within the apertures to fixedly secure disc 160 within slot 132. In one embodiment, a biasing element, such as a spring, a button and/or another suitable mechanism, retains pin 174 within the apertures, as desired. Pin 174 is released from within the apertures to rotate disc 160 within slot 132 and about the center axis of disc 160 to adjust the angular position of shaft 144 with respect to z-axis 128.

As shown in FIG. 14, in a further alternative embodiment base 142 forms a block 180 having an outer surface 182 defining a passage 184 that extends perpendicular to longitudinal axis 124 with stabilizer 140 positioned in a first position along z-axis 128. Passage 184 is configured to receive shaft 144 or, in certain embodiments, collar 150. Locking mechanism 170 fixedly secures block 180 in a selected rotational position within slot 132 to retain shaft 144 at an angular position with respect to z-axis 128. As shown in FIG. 14, a plurality of positioning apertures 186 is defined within archery bow 120 in a generally linear configuration. With shaft 144 positioned at a desired angular position, a pin 188 or another suitable locking mechanism is positioned within a corresponding positioning aperture 186 to secure block 180 within slot 132. In one embodiment, a biasing element, such as a spring, a button and/or another suitable mechanism, retains pin 188 within positioning aperture 186, as desired. Pin 188 is released from within positioning aperture 186 to rotate block 180 within slot 132 to adjust the angular position of shaft 144 with respect to z-axis 128.

As shown in FIG. 15, in a further alternative embodiment base 142 forms a block 190 having an outer surface 192 defining a plurality of passages 194 that extend at least partially through block 190 and generally parallel to adjacent passages 194 and perpendicular to longitudinal axis 124 with stabilizer 140 positioned in a first position along z-axis 128. Passages 194 are configured to receive shaft 144 or, in certain embodiments, collar 150. Shaft 144,is removably positionable within a selected passage 194. In one embodiment, block 190 is pivotally or rotationally movable within slot 132 and with respect to archery bow 120 to position shaft 144 in the desired angular position with respect to a passage axis 195 initially parallel to z-axis 128. In one embodiment, a suitable locking mechanism (not shown) fixedly secures block 190 in a selected rotational position within slot 132 to retain shaft 144 at the desired angular position with respect to z-axis 128.

Exemplary embodiments of a method and apparatus for coupling an archery component or element, such as a bow stabilizer or vibration dampener, to an archery bow are described above in detail. The method and apparatus are not limited to the specific embodiments described herein, but rather, steps of the method and/or components of the apparatus may be utilized independently and separately from other steps and/or components described herein. Further, the described method steps and/or apparatus components can also be defined in, or used in combination with, other methods and/or apparatus, and are not limited to practice with only the method and apparatus as described herein.

While the invention has been described in terms of various specific embodiments, those skilled in the art will recognize that the invention can be practiced with modification within the spirit and scope of the claims.

What is claimed is:

1. An apparatus configured to couple a component to an archery bow, the archery bow defining a longitudinal axis and a lateral axis coplanar with and perpendicular to the longitudinal axis, and an opening extending at least partially through the archery bow, said apparatus comprising a base positioned within the opening and pivotally movable about the lateral axis, said base defining at least one passage configured to receive the component.

2. An apparatus in accordance with claim 1 wherein the archery bow further defines a z-axis intersecting the longitudinal axis and the lateral axis and perpendicular thereto, the opening defines a bore extending along the lateral axis and at least one slot along a slot centerline coplanar with the longitudinal axis, the at least one slot interfering with the bore, said base positioned within the bore and said at least one passage in communication with the at least one slot.

3. An apparatus in accordance with claim 1 wherein the opening defines a slot along a slot centerline coplanar with the longitudinal axis, said base positioned within the slot.

4. An apparatus in accordance with claim 1 further comprising a collar coupled to said base, said collar configured to receive the component.

5. An apparatus in accordance with claim 1 wherein said at least one passage defines an axis coplanar with the longitudinal axis.

6. An apparatus in accordance with claim 1 wherein said base is pivotally movable to position the component at a selected angular position with respect to the archery bow.

7. An apparatus in accordance with claim 1 further comprising a locking mechanism operatively coupled to said base and configured to selectively retain said base stationary within the opening.

8. An apparatus in accordance with claim 1 wherein said base forms at least one projection on an outer surface of said base, said at least one projection frictionally interfering with at least one cooperating projection formed on an inner surface of the archery bow defining the opening to facilitate retaining said base at a selected angular position within the opening.

9. An apparatus in accordance with claim 1 further comprising a locking mechanism, said base defines at least one aperture configured to receive said locking mechanism for facilitating retaining said base at a selected rotational position within the opening.

10. An apparatus in accordance with claim 9 wherein said locking mechanism further comprises a pin positioned within said at least one aperture.

11. An apparatus in accordance with claim 1 wherein said base comprises a disc, said disc defining a plurality of passages, each passage of said plurality of passages extending radially towards the lateral axis and configured to receive the component.

12. An apparatus in accordance with claim 1 wherein said base defines a plurality of passages, each passage of the plurality of passages extending at least partially through said base parallel to an adjacent passage and perpendicular to the longitudinal axis with said base at a first position, each passage configured to receive the component, said base pivotally movable between the first position and a second position radially offset with respect to a z-axis of the archery bow.

13. An apparatus in accordance with claim 1 further comprising a locking mechanism comprising a biasing element positioned within an aperture of a plurality of apertures defined within the archery bow to selectively retain said base stationary within the opening.

14. An apparatus configured to couple a component to an archery bow, the archery bow defining a longitudinal axis and a lateral axis coplanar with and perpendicular to the longitudinal axis, and a z-axis intersecting the longitudinal axis and the lateral axis and perpendicular thereto, the archery bow defining a bore extending along the lateral axis and at least one slot formed along a slot centerline coplanar with the longitudinal axis, the at least one slot interfering with the bore, said apparatus comprising a base positioned within the bore and pivotally movable about the lateral axis, said base defining at least one first passage aligned with the at least one slot and configured to receive the component.

15. An apparatus in accordance with claim 14 further comprising a collar coupled to said base, said collar positioned at least partially within the slot.

16. An apparatus in accordance with claim 15 wherein said collar is positioned within said at least one first passage and defines a second passage configured to receive the component.

17. An apparatus configured to couple a component to an archery bow, the archery bow defining a longitudinal axis and a lateral axis coplanar with and perpendicular to the longitudinal axis, the archery bow further defining a slot along a slot centerline coplanar with the longitudinal axis, said apparatus comprising a base positioned within the slot and pivotally movable about the lateral axis, said base defining at least one passage having a center axis that intersects the lateral axis, said at least one passage configured to receive the component.

18. An apparatus in accordance with claim 17 further comprising a collar coupled to said base, said collar positioned at least partially within the slot.

19. An apparatus in accordance with claim 17 wherein said base is movable along the slot centerline.

20. An apparatus configured to couple a component to an archery bow, the archery bow defining a longitudinal axis and a lateral axis coplanar with and perpendicular to the longitudinal axis, and an opening extending at least partially through the archery bow along the lateral axis, said apparatus comprising:

a base positioned within the opening and pivotally movable about the lateral axis, said base defining at least one passage configured to receive the component; and a locking mechanism operatively coupled to said base and configured to selectively retain said base stationary within the opening.

21. An apparatus in accordance with claim 20 wherein said locking mechanism is positioned within an aperture defined within said base for facilitating retaining said base at a selected rotational position within the opening.

22. An apparatus in accordance with claim 21 wherein said locking mechanism further comprises a pin positioned within said aperture.

23. An apparatus in accordance with claim 20 wherein said locking mechanism further comprises a biasing element positioned within an aperture of a plurality of apertures defined within the archery bow to selectively retain said base stationary within the opening.

24. An apparatus for coupling a component to an archery bow, the archery bow defining a longitudinal axis and a lateral axis coplanar with and perpendicular to the longitudinal axis, and a z-axis intersecting the longitudinal axis and the lateral axis and perpendicular thereto, the archery bow further defining an opening extending at least partially through the archery bow, said apparatus comprising a base positioned within the opening, said base defining at least one passage having a center axis that intersects the lateral axis and configured to receive the component, said base pivotally movable to position the component with respect to at least one of the longitudinal axis, the lateral axis and the z-axis.

25. An apparatus in accordance with claim 24 wherein the opening defines a bore extending along the lateral axis, and at least one slot formed along a slot centerline coplanar with the longitudinal axis and interfering with the bore, said base positioned within the bore and pivotally movable about the lateral axis, said at least one passage aligned with the at least one slot.

26. An apparatus in accordance with claim 24 wherein the opening defines a slot formed along a slot centerline coplanar with the longitudinal axis, said base positioned within the slot.

27. A method for coupling a component to an archery bow, the archery bow defining a longitudinal axis and a lateral axis coplanar with and perpendicular to the longitudinal axis, and a z-axis intersecting the longitudinal axis and the lateral axis and perpendicular thereto, said method comprising:

positioning at least a portion of an apparatus base within the archery bow, the base defining a passage having a center axis that intersects the lateral axis and that is configured to receive the component;

coupling the component to the base; and pivotally moving the base with respect to the archery bow to selectively position the component with respect to at least one of the longitudinal axis, the lateral axis and the z-axis.

28. A method in accordance with claim 27 wherein pivotally moving the base further comprises pivoting the base about the lateral axis within a slot defined by the archery bow to position a shaft of the component at an angular position with respect to the z-axis.

29. A method in accordance with claim 28 further comprising locking the base within the slot to retain the shaft at the selected angular position.

30. A method in accordance with claim 27 wherein, with the archery bow defining a bore extending along the lateral axis, and at least one slot formed along a slot centerline coplanar with the longitudinal axis and interfering with the bore, said method further comprises:

aligning the passage defined within the base with the slot;

mounting a shaft of the component within the passage; and pivoting the base about the lateral axis within the bore to position the shaft at an angular position with respect to the z-axis.

31. An archery bow defining a lateral axis and an opening extending at least partially through the archery bow, said archery bow comprising an apparatus comprising a base positioned within the opening and pivotally movable about the lateral axis, said base defining at least one first passage, and a component mounted within said at least one first passage, said archery bow configured to enable a user to select an orientation of the component with respect to an axis of the archery bow.

32. An archery bow in accordance with claim 31 wherein said component comprises at least one of a sight, a vibration dampener and a stabilizer.

33. An archery bow in accordance with claim 31 wherein said base and said component are collinear.

34. A stabilizer for an archery bow, the archery bow defining a longitudinal axis and a lateral axis coplanar with and perpendicular to the longitudinal axis, and a z-axis intersecting the longitudinal axis and the lateral axis and perpendicular thereto, the archery bow further defining an opening extending at least partially through the archery bow, the opening defining a bore extending along the lateral axis, and at least one slot formed along a slot centerline coplanar with the longitudinal axis, the at least one slot interfering with the bore, said stabilizer comprising:

a base pivotally positioned within the bore and defining at least one passage; and a shaft removably coupled to said base, said base movable within the opening to position said shaft with respect to the z-axis, wherein said at least one passage is aligned with the at least one slot and configured to receive said shaft.

35. A stabilizer for an archery bow, the archery bow defining a longitudinal axis and a lateral axis coplanar with and perpendicular to the longitudinal axis, and a z-axis intersecting the longitudinal axis and the lateral axis and perpendicular thereto, the archery bow further defining an opening extending at least partially through the archery bow, the opening defining a slot formed along a slot centerline, said stabilizer comprising:

a base pivotally positioned within the slot; and a shaft removably coupled to said base, said base movable within the slot to position said shaft with respect to the z-axis, wherein , said base defines at least one passage, and said shaft is mounted within said at least one passage.

* * * * *